US006499386B2

(12) United States Patent
Martin et al.

(10) Patent No.: US 6,499,386 B2
(45) Date of Patent: Dec. 31, 2002

(54) LIQUID-COOLED PISTON

(75) Inventors: Edgar Martin, Hersbruck (DE); Stephan Thieme, Ottensoos (DE)

(73) Assignee: Federal-Mogul Nürnberg GmbH (DE)

( * ) Notice: Subject to any disclaimer, the term of this patent is extended or adjusted under 35 U.S.C. 154(b) by 0 days.

(21) Appl. No.: 10/032,527

(22) Filed: Dec. 27, 2001

(65) Prior Publication Data

US 2002/0162448 A1 Nov. 7, 2002

Related U.S. Application Data

(63) Continuation of application No. PCT/EP00/05633, filed on Jun. 19, 2000.

(30) Foreign Application Priority Data

Jul. 2, 1999 (DE) ..... 199 30 630

(51) Int. Cl.[7] ..... F01B 37/08
(52) U.S. Cl. ..... 92/186
(58) Field of Search ..... 92/186

(56) References Cited

U.S. PATENT DOCUMENTS

| | | | | |
|---|---|---|---|---|
| 4,180,027 | A | 12/1979 | Taylor | |
| 4,331,107 | A | 5/1982 | Bruni | |
| 5,845,611 | A | 12/1998 | Schmidt et al. | |
| 6,164,249 | A | 12/2000 | Honold et al. | 123/41.35 |

FOREIGN PATENT DOCUMENTS

| | | |
|---|---|---|
| DE | 1751342 | 6/1970 |
| DE | 3019953 | 12/1980 |
| DE | 3444661 | 6/1986 |
| DE | 19522756 | 1/1997 |
| DE | 19618625 | 10/1997 |
| DE | 19736135 | 10/1998 |
| DE | 19810937 | 11/1999 |

*Primary Examiner*—F. Daniel Lopez
(74) *Attorney, Agent, or Firm*—Cooper & Dunham LLP

(57) ABSTRACT

The invention relates to a liquid-cooled piston (10) for internal combustion engines having a cooling duct (16) that has an annular shape or consists of several annular segments, said duct having a substantially constant cross section along its extension and extending in an undulated manner at least in certain areas in the direction of the axis of the piston (18).

7 Claims, 2 Drawing Sheets

LIQUID-COOLED PISTON

This application is a continuation application of International Application No. PCT/EP00/05633 with an international filing date of Jun. 19, 2000, published in German under PCT Article 21(2).

TECHNICAL FIELD

The invention concerns a liquid-cooled piston.

The pistons of internal combustion engines are subjected to great thermic stress due to combustion which occurs in the combustion chamber. For this reason, it is advisable, especially in diesel engines and supercharged engines, to ensure the cooling of pistons by introducing a coolant into cavities in the piston.

PRIOR ART

A liquid cooled piston is known from DE-OS 30 19 953. This piston has an annular duct, to which an open bore which extends to the crank space is adjoined, through which the cooling oil can flow in. Oil flows out of the known piston through an outlet bore, which is located at approximately the center of the piston (when seen from above). It is also possible to position the coolant outflow in a position which is diametrically opposite the inflow. In the known piston, the entire annular duct is located at a specific height of the piston. Hereby, a useful cooling of the fire land area, i.e. the area behind the piston ring, as well as the area below the combustion chamber is achieved. The piston-pin bores, which are subject to great stress particularly in high speed diesel engines, and the area surrounding these, are not however sufficiently cooled.

This disadvantage is also true of the piston according to DE 195 22 756 A1, in which cooling of the area behind the piston rings is achieved by bores which extend substantially in the direction of the piston axis.

Also, in pistons according to DE 34 44 661 A1, the cooling ducts, which are arranged in a star-shape, are so formed that they cool in particular the area behind the rings as well as the combustion chamber area. Satisfactory cooling of the piston-pin boss area can only be ensured by providing complicated casting cores which can only be removed from the completed pistons with great effort.

The cooling ducts of the piston according to DE 196 18 625 C1 are comparatively simply constructed, however they are located so far away from the piston-pin boss area that adequate cooling is not achieved in this zone.

A piston having an annular cooling duct, the top-side of which has asymmetric ramps and the bottom-side has troughs offset in a circumferential direction is known from DE 198 10 937 C1, which was not pre-published. Efficient delivery of the oil through the cooling ducts is hereby supposed to be achieved.

German Patent DE 197 36 135 C1 discloses a liquid-cooled piston having a cooling duct which, with two separate limbs, extends upwardly inclined starting from a radial edge to the center and thereafter extends downwardly inclined to the opposite radial edge. When seen from above, the two limbs as a whole form an X-shape. This should lead to improved cooling of the piston head.

Finally a piston for internal combustion engines with inclined or horizontally located cylinders is known from DE PS 17 51 342, where steps which are offset against each other are located on the inner walls of the cooling duct to achieve a reliable delivery and flow of the cooling duct also in inclined pistons. However, the cooling duct is also too far away from the piston-pin boss area in this case to ensure sufficient cooling in this zone in modern, high speed diesel engines. Furthermore, the complex internal design of this cooling duct requires complex casting cores.

DESCRIPTION OF THE INVENTION

The object of the invention is to create a liquid-cooled piston which is easy to produce and which effectively cools the ring area as well as the piston-pin boss area, wherein the strength demands placed on the piston continue to be met.

As a result, the cooling duct of the piston according to the invention which, when viewed as an entirety from above, has an extensive annular shape or consists of several annular segments which are designed in the direction of the axis piston in an undulated manner. Herein, the cross section of the cooling duct remains basically the same across the whole extent of the cooling duct, so that for example in contrast to the piston according to DE-PS 17 51 342, no unnecessary complication of the cooling duct design is required.

Rather the cooling duct extends with a substantially constant cross section in an undulated manner as seen in a side-view of the piston, so that it extends from the area behind the piston rings closer to the piston-pin boss in certain sections than is the case with known pistons. A reliable cooling of both these areas can thus be achieved. Furthermore, the undulated design presents a further advantage in that the cooling duct will be longer in total so that in contrast to conventional cooling ducts, it has a larger cooling surface, and cooling performance can be increased. In addition, the undulated shape of the cooling duct allows for a smaller distance between the cooling duct and the annular support, since sufficient material remains behind the annular supports in each of the wave troughs and thus strength demands will be met as a whole.

The undulated shape of the cooling duct also ensures that, in contrast to known cooling ducts which remain at one level, the cooling oil does not flow straight through, but rather remains in the cooling duct for a longer dwell time and can thus absorb more heat. Finally, in contrast to conventional cooling ducts, cooling of the areas surrounding the cooling duct does not only occur on one side. To a certain extent, the cooling duct not only cools the areas surrounding it, but with regard to a wave trough, cooling also occurs from the wave trough as well as from both neighboring wave crests in the direction of the wave trough. This mode of action can also improve the cooling performance.

In tests, one design of the cooling duct, in which the distance between the wave trough and the wave crest was 1.5 times greater than the cross section of the cooling duct, proved to be particularly advantageous. In other words the measured distance extending in the direction of the axis piston between the lowest point of a wave trough and the highest point of a wave crest is at least 1.5 times the distance between the lowest point of a wave trough and the highest point of the cooling duct in the wave trough, which corresponds to the cross section of the cooling duct.

The measures according to the invention advantageously allow the thickness of the wall between the cooling duct and the annular supports to be reduced to 0–10 mm, preferably 0–5 mm, and in particular 0–2 mm. To improve cooling, the cooling duct can hereby run particularly close to the annular supports, and even have contact with them so that the inside surface of the annular support intermittently touches the cooling duct. A wall thickness which is sufficient to provide adequate stability remains herein due to the undulated progression in the wave troughs.

The design of the undulated cooling duct should preferably have an uneven number of complete waves in one half of the annular extension of the cooling duct. In other words, an uneven number of wave crests can be seen in an imaginary, sectional side view through the cooling duct so that a wave crest is located above the piston-pin bore. If there is an even number, a wave trough would be located here so that in certain situations there would be an insufficient material thickness between the wave trough and the piston-pin bore. Such an undesirable weakness in the piston can be reliably avoided if the number of waves is uneven so that a wave crest is located above the piston-pin bore, which in view of its shape fits particularly well to the form of the upper half of the piston-pin bore.

Finally, with regard to the shape of the cross section of the cooling duct, an oval design, which is preferably inclined outwards, has proved to be particularly advantageous. In other words, in a sectional side view, the upper section of the oval shaped cooling duct is closer to the outer wall of the piston than the lower section.

BRIEF DESCRIPTION OF THE DRAWINGS

An Example of an embodiment of the invention shown in the drawings is explained below in more detail.

It shows.

DETAILED DESCRIPTION OF THE PREFERRED EMBODIMENTS OF THE INVENTION

Figure 1:
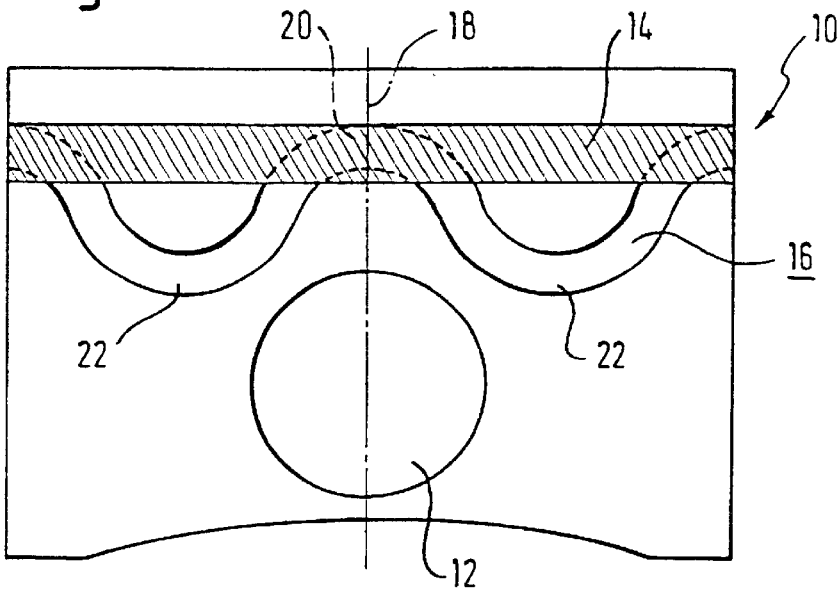
FIG. 1 a schematic side view of the piston according to the invention.

In FIG. 1, the piston 10 according to the invention is illustrated in a side view in the direction of the piston-pin boss 12. The piston 10 as illustrated has an annular support 14 in its upper section. The cooling of the annular support 14 area and the area surrounding the piston-pin boss 12 must be particularly reliable. A substantially annular (when seen from above) cooling duct 16, which runs in parallel to the circumference of the piston, is provided for this purpose.

To combine a reliable cooling of the annular support 14 area and the areas surrounding the piston-pin boss 12, the cooling duct 16 according to the invention runs towards the piston axis 18 in an undulated manner so that it extends between these areas. In the illustrated embodiment, a wave crest 20 is situated particularly advantageously above the piston-pin boss 12 which, together with the additional wave crests, ensures the reliable cooling of the annular support 14 area. Although the thickness of the wall between the wave crests 20 and the annular support 14 is comparatively thin, strength is maintained overall since the thickness of the wall behind the annular support 14 is not as dramatically reduced as in the wave trough 22 area.

By means of wave troughs 22, the cooling duct 16 runs particularly close to the piston-pin boss 12 in these sections so that the area surrounding the piston-pin boss can also be suitably cooled. Due to the preferred measure as seen in FIG. 1, according to which there is an uneven number of complete wave crests in one half of the cooling duct, a wave crest, as can be seen from the example shown in FIG. 1, is located above the piston-pin boss 12, so that there is still a sufficient wall thickness in this area.

Figure 2:
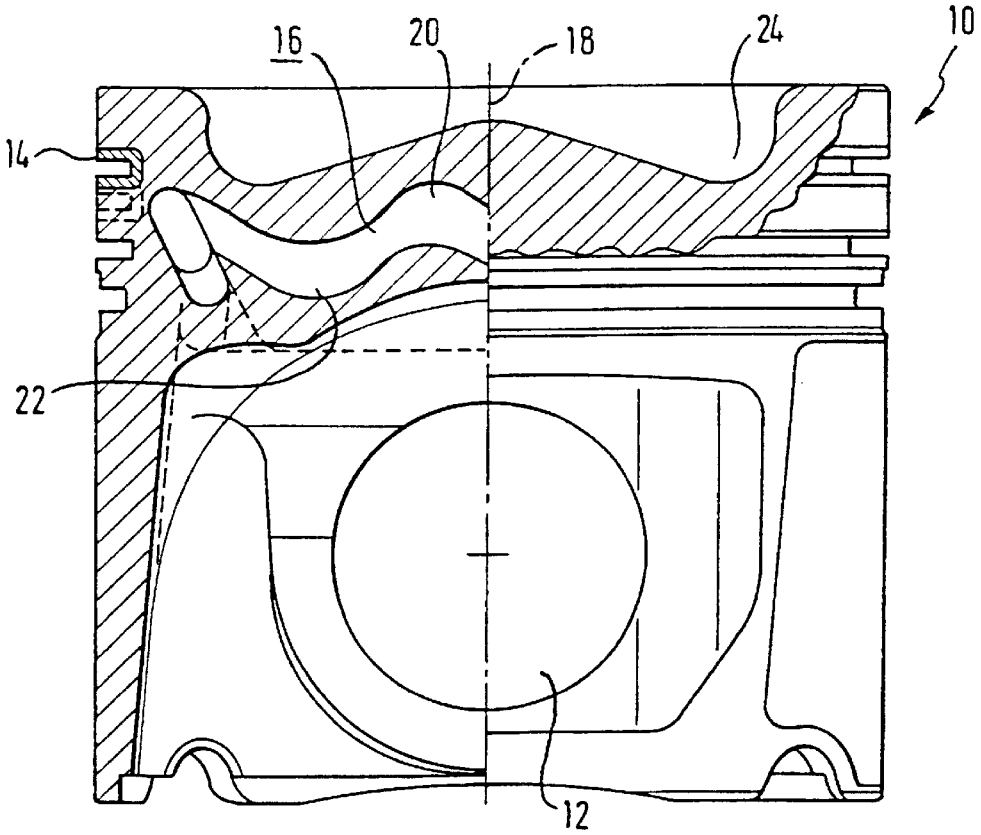
FIG. 2 a side view of the piston according to the invention with a part-section.

This area is designed differently in the embodiment shown in detail in FIG. 2. However, in this embodiment, a sufficient material thickness can also be achieved in the area above the piston-pin bore 12 due to the practical design of the undulated cooling duct 16. An annular support 14, to which the cooling duct 16 comes comparatively close in the wave crest area, can be seen in detail in the left-hand section of FIG. 2. As can also be seen from the section of FIG. 2, the cooling duct 16 in the given example is designed in a oval shape which extends in the direction of the axis piston 18 with this being inclined slightly outwardly. In addition, FIG. 2 shows that the distance from the lowest point of a wave trough 22 to the highest point of a wave crest 20 is approximately double that of the cooling duct cross section as seen in the side view of FIG. 2.

Figure 3:
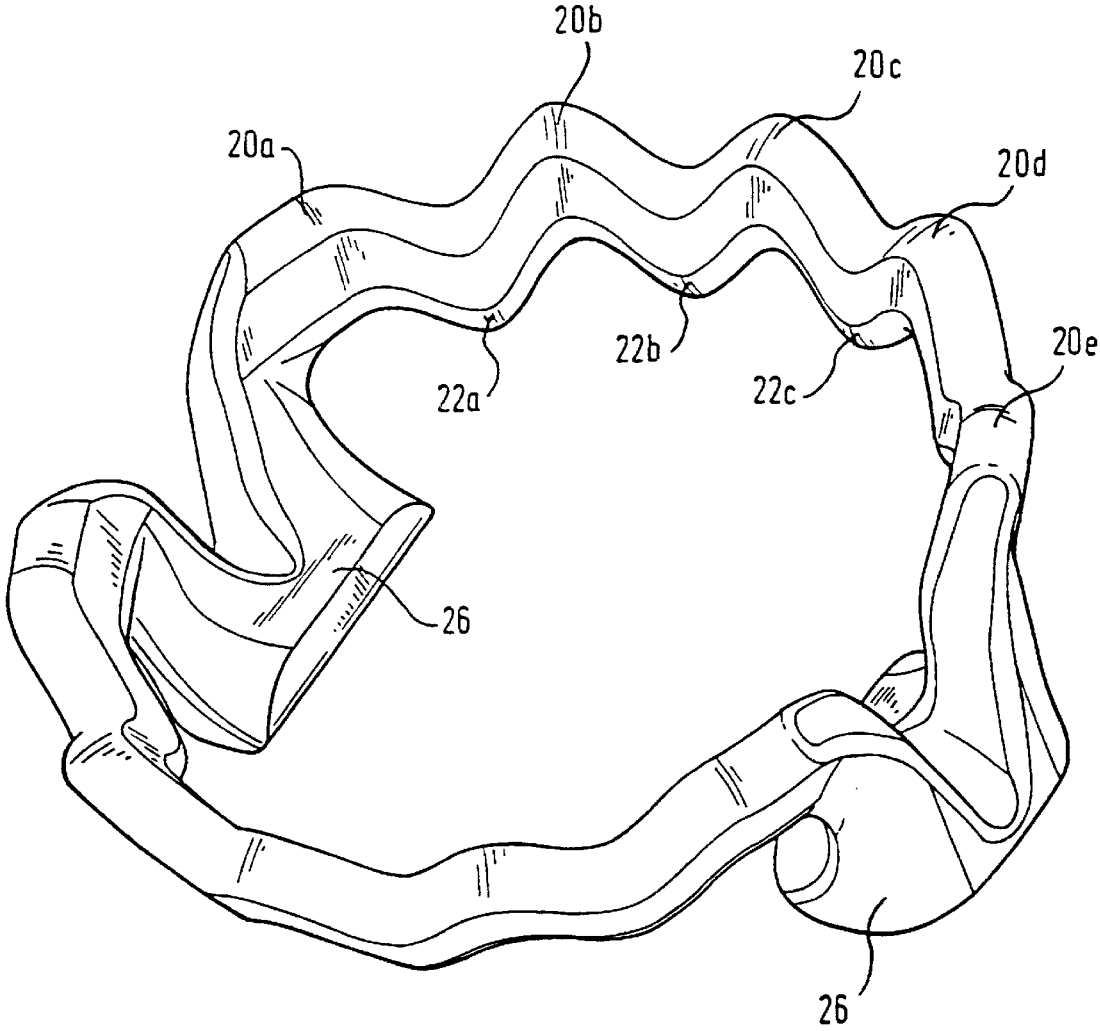
FIG. 3 a perspective view of the interior of the cooling duct of the piston according to the invention.

A perspective view of the interior of the cooling duct 16 is shown in FIG. 3. A casting core, which is introduced to the casting of the piston 10 according to the invention, would, to a certain extent, correspond approximately to the design shown in FIG. 3. It can be seen from the illustration that the cooling duct 16 in the example shown has two inlet/outlet areas 26 lying diametrically opposite each other whose cross section is approximately double the size of the cross section area of the cooling duct 16. Starting from the respective inlet/outlet area 26, the cooling duct 16 is constructed as a whole by two annular segments as seen in the top view which are each roughly shaped in a semi-circle. A substantially annular design of the cooling duct 16 can hereby be seen together with the inlet/outlet areas 26. Starting from the respective inlet/outlet area 26, the cooling duct firstly extends to a first wave crest 20*a* in the direction of the piston head. The wave trough 22*a* and three complete wave crests, 20*b*, 20*c* and 20*d* follow this first wave crest 20*a*, before the cooling duct opens out into the opposite inlet/outlet area 26 via the wave crest 20*e*. The other half of the annular cooling duct 16 is designed in a similar way.

As already indicated with reference to FIG. 1, the uneven number of, in this case, five complete waves in the half of the cooling duct 16 explained above, results in a wave crest, designated 20*c* in the illustration shown, being located above the piston-pin bore. Hereby, as already mentioned, the required thickness of the wall can be ensured, whereby a reliable cooling of the area surrounding the piston-pin bore can be achieved in particular by means of the neighboring wave troughs 22*b* and 22*c*.

With the wave crest 20, the cooling duct with the interior as shown in FIG. 3 runs particularly close to the ring support of the piston so that this area is also reliably cooled. Furthermore a larger inner surface of the cooling duct results, in comparison with the shape of a cooling duct which constantly remains at the same level, as well as a lengthy dwell time of the cooling oil so that the cooling performance can be increased. As can also be seen from FIG. 3, the design of the interior of the cooling duct 16 results as a whole in a "crown shaped" form.

What is claimed is:

1. Liquid-cooled piston (10) for internal combustion engines having a cooling duct (16) that has an annular shape or consists of several part annular segments, said duct having a substantially constant cross section along an axis of the piston, characterized in that the duct (16) extends in a recurrent undulated manner at least in certain sections in the direction of the axis of the piston (18).

2. A piston as in claim 1, characterized in that a distance between a wave trough (22) and a wave crest averages greater than 1.5 times a dimension of the cooling duct extending in the direction of the axis of the piston (18).

3. A piston as in claim 1, characterized in that a thickness of a wall between cooling duct (16) and annular supports (14) is 0–10 mm.

4. A piston as in claim 1, characterized in that there is an uneven number of complete waves in one half of the cooling duct (16) so that a wave crest **(20*c*) is located above a piston-pin bore (12)**.

5. A piston as in claim 1, characterized in that the cross section of the cooling duct (16) is basically oval and is inclined outwards.

6. A piston as in claim 1, and further comprising that a thickness of a wall between the cooling duct and annular supports is between 0–5 mm.

7. A piston as in claim 1, and further comprising that a thickness of a wall between the cooling duct and annular supports is between 0–2 mm.

* * * * *